United States Patent [19]

Ando et al.

[11] Patent Number: 4,584,066

[45] Date of Patent: Apr. 22, 1986

[54] METHOD AND APPARATUS FOR THE CONTINUOUS ELECTROLYTIC TREATMENT OF A METAL STRIP USING INSOLUBLE HORIZONTAL ELECTRODES

[75] Inventors: Narumi Ando, Tokyo; Kito Oda, Futtsu; Takashi Saiki; Yoshiaki Hashimoto, both of Kisarazu; Akira Tsuyuki, Kimitsu; Yoshio Kitazawa, Tokyo, all of Japan

[73] Assignee: Nippon Steel Corporation, Tokyo, Japan

[21] Appl. No.: 669,733

[22] Filed: Nov. 8, 1984

Related U.S. Application Data

[63] Continuation of Ser. No. 330,598, Dec. 14, 1981, abandoned.

[30] Foreign Application Priority Data

Dec. 16, 1980 [JP] Japan ..... 55-176518

[51] Int. Cl.[4] ..... C25D 5/08; C25D 7/06

[52] U.S. Cl. ..... 204/28; 204/206; 204/275

[58] Field of Search ..... 204/28, 206–211, 204/140, 237, 275

[56] References Cited

U.S. PATENT DOCUMENTS

| | | | |
|---|---|---|---|
| 3,975,242 | 8/1976 | Matsuda et al. | 204/28 |
| 4,119,516 | 10/1978 | Yamaguchi | 204/224 R |
| 4,183,799 | 1/1980 | Sellitto et al. | 204/206 |
| 4,267,024 | 5/1981 | Weiskopf | 204/15 |
| 4,367,125 | 1/1983 | Avellone | 204/28 |

*Primary Examiner*—Andrew H. Metz
*Assistant Examiner*—William T. Leader
*Attorney, Agent, or Firm*—Kenyon & Kenyon

[57] ABSTRACT

A continuous electrolytic treatment can be applied to a metal strip by the method which comprises the steps of (1) passing a metal strip through a narrow treating space formed between horizontal upper and lower electrode devices, each having at least one insoluble electrode, whereby the treating space is divided into two gaps by the metal strip; (2) feeding an electrolytic treating liquid to the gaps through slits each formed in the middle portion of the electrode device in such a manner that the slit horizontally extends across the electrode device at right angles to the direction of passage of the metal strip and directed vertically toward the metal strip, whereby each stream of the treating liquid can be divided into two opposite flows in the gap; and (3) applying an electric current between each electrode and the metal strip.

20 Claims, 12 Drawing Figures

CURRENT DENSITY (A/DM²)
200
150
100
50
A
B
50
100
150
SPEED OF METAL STRIP (M/MIN)

ELECTROPLATING VOLTAGE (V)
50
40
30
20
10
D
C
50
100
150
200
CURRENT DENSITY (A/DM²)

METHOD AND APPARATUS FOR THE CONTINUOUS ELECTROLYTIC TREATMENT OF A METAL STRIP USING INSOLUBLE HORIZONTAL ELECTRODES

This application is a continuation of application No. 330,598, filed Dec. 14, 1981, now abandoned.

FIELD OF THE INVENTION

The present invention relates to a method and apparatus for the continuous electrolytic treatment of a metal strip using insoluble horizontal electrodes.

More particularly, the present invention relates to a method and apparatus for the continuous treatment of a metal strip with an electrolytic treating liquid while moving the metal strip horizontally at a high speed of 150 m/min or more between horizontal electrodes substantially insoluble in the electrolytic treating liquid, without causing any defects on the resultant treated metal strip.

BACKGROUND OF THE INVENTION

It is known that a metal strip can be continuously treated with an acid or alkaline electrolytic treating liquid while moving the metal strip along a horizontal or vertical path provided between a pair of horizontal or vertical electrodes, either soluble or insoluble in the electrolytic treating liquid, by passing the electrolytic treating liquid through the gaps between each electrode and the metal strip and by applying a voltage between each electrode and the metal strip so as to generate a desired intensity of electric current therebetween. The electrodes may be either anodes or cathodes, whereby the metal strip serves as either the cathode or anode, respectively.

For example, in the case where a metal strip is continuously electroplated with zinc by using a horizontal-type electroplating cell, a pair of insoluble electrodes, and an acid electrolytic solution containing zinc, the amount of the electrodeposited zinc layer on the metal strip is governed by Faraday's law. That is, one faraday (96,500 coulombs) of electricity applied to the electroplating system results in deposition of one gram equivalent of the metal, that is, 32.5 g of zinc, on the metal strip. This electrodeposition phenomenon is governed by the following equation:

$$I = 49.2 \frac{W \cdot V \cdot Cw}{\eta}$$

wherein, I denotes the intensity of electric current in amperes; W represents the width of the metal strip to be plated in mm; V represents the moving speed of the metal strip in m/min; Cw represents the weight of the electrodeposited metal layer in g/m$^2$; and $\eta$ represents the current efficiency.

The value of W is determined by the width of the metal strip to be plated. The value of Cw is determined by the weight or thickness of the plated metal film instructed by the customer. The value of $\eta$ is determined by the type of metal to be electrodeposited.

Therefore, it is obvious that if one wishes to increase the productivity of the electroplated metal strip by increasing the moving speed of the metal strip, it is necessary to increase the value (I) of the electric current, to be applied to the electroplating system, in proportion to the increased moving speed of the metal strip.

However, it is known that when the electroplating procedure is carried out at a high current density, for example, 100 A/dm$^2$ or more, use of a conventional electroplating apparatus suitable for a relatively low current density, for example, less than 100 A/dm$^2$, results in undesirable so-called burnt deposites on the metal film electrodeposited on the metal strip. Also, for high current density to be used with conventional electroplating apparatus, it is necessary to apply undesirably increased voltage between the electrodes (anode) and the metal strip (cathode).

If it is desired to operate the continuous electrolytic treatment process at a high speed of 150 to 300 m/min using conventional electrolytic treating cells suitable for a relatively low current density of below 100 A/dm$^2$, the only way to avoid the above-mentioned disadvantages would be to use a plurality of the conventional electrolytic treating cells. This would, however, result in high costs.

SUMMARY OF THE INVENTION

An object of the present invention is to provide a method and apparatus for the continuous electrolytic treatment of a metal strip with an electrolytic treating liquid, using horizontal electrodes substantially insoluble in the electrolytic treating liquid, at a high speed and at a large current density without excessively increasing the voltage to be applied.

Another object of the present invention is to provide a method and apparatus for the continuous electrolytic treatment of a metal strip with an electrolytic treating liquid, using horizontal electrodes substantially insoluble in the electrolytic treating liquid, at a high speed and at a large current density without generating burnt deposits and another defects on the treated metal strip.

The method of the present invention which allows the above-mentioned objects to be attained, comprises the steps of:

moving a metal strip horizontally through a narrow treating space formed between horizontal upper and lower electrode devices facing each other, each device comprising at least one electrode substantially insoluble in the electrolytic treating liquid to be applied, whereby the treating space is divided into upper and lower horizontal gaps by the metal strip;

feeding upper and lower streams of said electrolytic treating liquid into the upper and lower gaps, respectively, through upper and lower slits, each formed in the middle portion of the corresponding electrode device, each extending horizontally across the corresponding electrode device at substantially right angles to the direction of movement of the metal strip, and each directed vertically to the corresponding gap at substantially right angles to the surface of the metal strip, whereby each stream of said electrolytic treating liquid passed into the corresponding gap is divided into a pair of flows concurrent and countercurrent with the movement of the metal strip, each flow having a uniform flow rate over the corresponding surface of the metal strip; and applying an electric current between each electrode and the metal strip, whereby the metal strip is electrolytically treated with the electrolytic treating liquid.

The above-mentioned method can be carried out by using the apparatus of the present invention, which comprises:

means for feeding a metal strip;

means for delivering said metal strip, which means is located downstream of the feeding means in such a manner that a horizontal path of movement for the metal strip is provided between the feeding means and the delivery means;

upper and lower horizontal electrode devices which are arranged, respectively, above and below the horizontal path of movement of the metal strip between the feeding means and the delivery means in such a manner as to form a treating space between the upper and lower electrode devices, the treating space being divided into upper and lower horizontal gaps by the horizontal path of movement of the metal strip, and for each electrode device comprising at least one horizontal electrode substantially insoluble in the electrolytic treating liquid to be applied to said metal strip and being provided with a slit for feeding the electrolytic treating liquid into the corresponding gap, which slit is formed in the middle portion of the electrode device, which slit extends horizontally across the electrode device at substantially right angles to the direction of movement of the metal strip, which slit is directed vertically to the corresponding gap at substantially right angles to the horizontal path of movement of the metal strip, and which slit is connected to a source of supplying of the electrolytic treating liquid; and means for applying an electric current between each electrode and the metal strip.

DETAILED DESCRIPTION OF THE INVENTION

In a conventional method for continuously treating a metal strip with an electrolytic treating liquid by using horizontal electrodes, the metal strip is moved along a horizontal path provided between horizontal upper and lower electrodes and the electrolytic treating liquid is passed concurrently with the movement of the metal strip. This type of conventional method can be carried out by using the apparatus indicated, for example, in FIG. 1.

Figure 1:
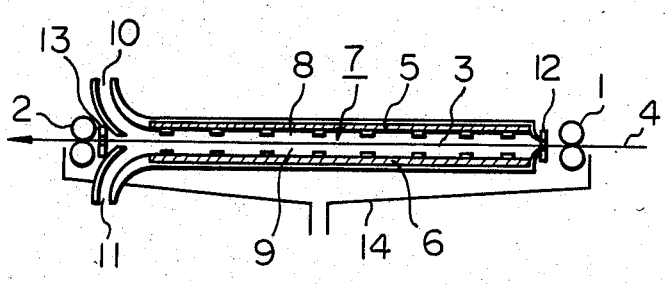
Fig. 1 PRIOR ART
FIG. 1 is an explanatory cross-sectional view of an apparatus of a prior art for the continuous electrolytic treatment of a metal strip.

Referring to FIG. 1, a pair of feeding rolls 1 and a pair of delivering rolls 2 are arranged so that a horizontal path 3 along which a metal strip 4 is moved is provided between the feeding rolls 1 and the delivering rolls 2.

Upper and lower electrodes 5 and 6 are arranged respectively above and below the path of movement 3 of the metal strip 4, between the feeding rolls 1 and the delivering rolls 2, so as to form a treating space 7 between the upper and lower electrodes 5 and 6. The treating space 7 is divided into horizontal upper and lower gaps 8 and 9 by the horizontal path of movement 3 of the metal strip 4. The horizontal upper and lower gaps 8 and 9 are connected to a source (not shown in FIG. 1) of supply of an electrolytic treating liquid to be applied to the metal strip 4, though upper and lower slits 10 and 11, which slits are located beside the delivering rolls 2 and inclined to the downstream side of the apparatus.

The upstream end of the treating space 7 is defined by upstream sealing rubber plates 12. The downstream end of the treating space 7 is defined by a pair of downstream sealing rubber plates 13. Accordingly, when the electrolytic treating liquid is fed into the upper and lower gaps 8 and 9 through the slits 10 and 11, respectively, the electrolytic treating liquid in each gap flows countercurrently with movement of the metal strip 4. A portion of the electrolytic treating liquid flows out from the treating space 7 through the openings between the upstream sealing plates 12 and between the downstream sealing plates 13 and is collected by a funnel-shaped collecter 14.

In the above-mentioned method, the electrolytic treating liquid flows through a relatively long length of the horizontal gaps only countercurrently with movement of the metal strip. Therefore, during the treating procedure, the surfaces of the electrodes are partially covered by bubbles of gas, for example, oxygen gas, generated from the electrolytic reaction occurring in the treating space. This phenomenon remarkably hinders the flow of the electric current between the electrodes and the metal strip and, therefore, the result of the electrolytic treatment is unsatisfactory. Also, when the above-mentioned method is carried out at a high speed of the metal strip, for example, 150 m/min or more, it is necessary to apply the electric current at a high density to the electrolytic treating system. This high current density frequently results in undesirable generation of burnt deposits on the treated metal strip.

Japanese Patent Application Publication (Kokoku) No. 51-32582 (1976) discloses a similar apparatus to that indicated in FIG. 1, except that the inclined upper and lower slits are located in the middle portion of the electrodes. In this type of apparatus, a stream of the electrolytic treating liquid is spouted into the upstream half portion of the corresponding gap countercurrently with movement of the metal strip.

A portion of the spouted electrolytic treating liquid is carried by the metal strip through the downstream half portion of the gap.

In the above-mentioned type of apparatus, it was found that gas bubbles, for example, oxygen gas bubbles formed on the surfaces of the electrodes due to the electrolytic reactions occurring in the electrolytic treating system, cannot be satisfactorily removed by the flow of the electrolytic treating liquid.

The above-mentioned disadvantages of the prior arts can be eliminated by the method and apparatus of the present invention.

Figure 2:
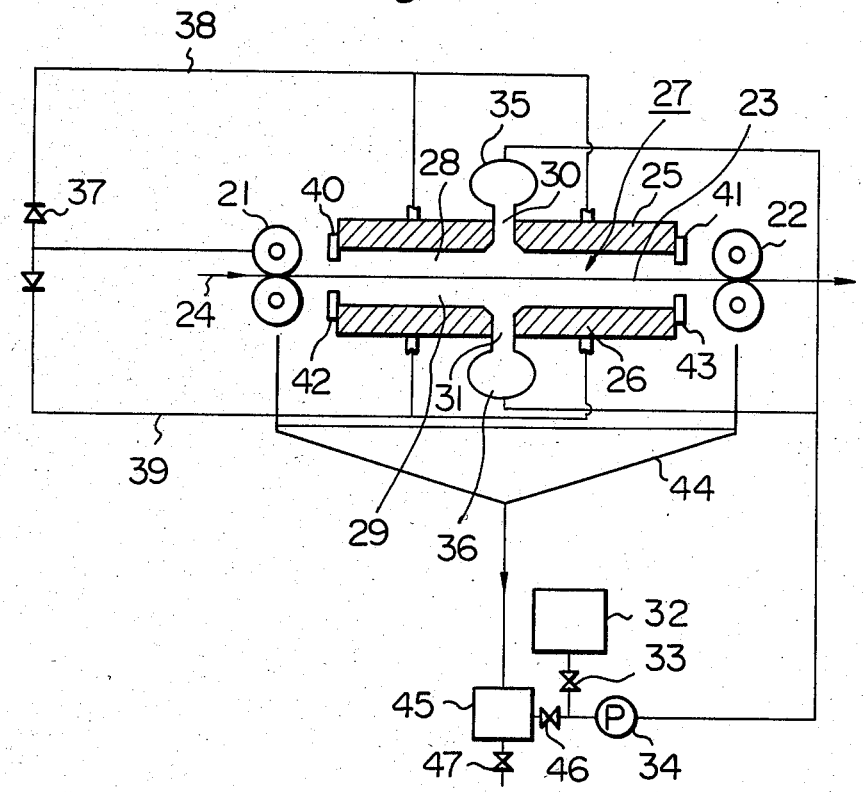
FIG. 2 is an explanatory cross-sectional view of an embodiment of the apparatus of the present invention.
Figure 3:
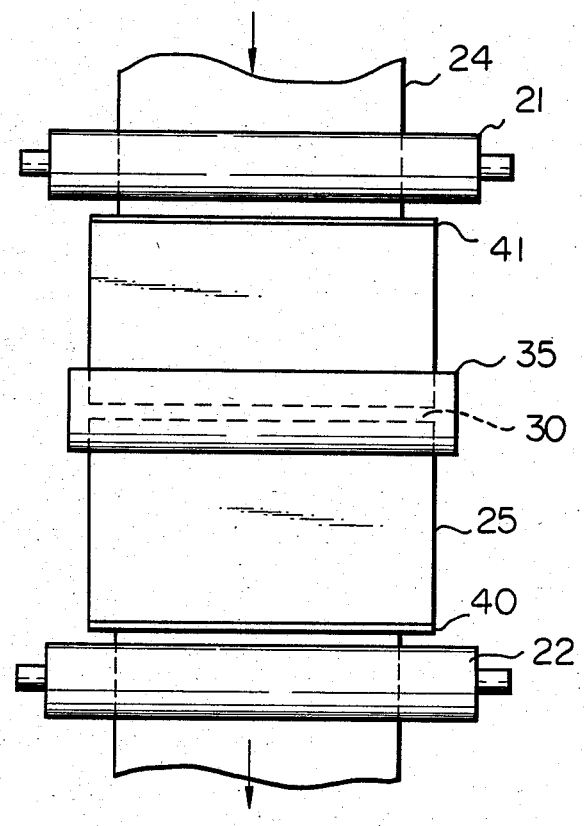
FIG. 3 is an explanatory plane view of the apparatus indicated in FIG. 2.

Referring to FIG. 2 which shows an explanatory cross-sectional profile of an embodiment of the apparatus of the present invention, and to FIG. 3 which is a plane view of the apparatus indicated in FIG. 2, feeding means comprising a pair of feeding rolls 21 and delivery means comprising a pair of delivering rolls 22 are arranged in such a manner that a horizontal path 23 along which a metal strip 24 can move horizontally is provided between the feeding rolls 21 and the delivering rolls 22.

Upper and lower electrode devices 25 and 26 are arranged, respectively, above and below the path of movement 23 of the metal strip 24 between the feeding rolls 21 and delivering rolls 22. Accordingly, a treating space 27 is formed between the upper and lower electrode devices 25 and 26. Also, when the metal strip 24 passes through the treating space 27, the treating space 27 is divided into a pair of horizontal upper and lower gaps 28 and 29 by the metal strip 24.

The thickness of the gaps are variable depending on the type of the electrolytic treatment and the feeding rate of the electrolytic treating liquid. Usually, it is preferable that the thickness of the gaps is 30 mm or less more preferable 5 to 15 mm. If the thickness of the gaps is more than 30 mm, sometimes, it becomes difficult to fill the gaps with the flow of the electrolytic treating liquid. Also, it is difficult to make the flow rate of the electrolytic treating liquid uniform over the surfaces of the metal strip. If the flow rate is not uniform, the electrolytic treatment on the metal strip becomes uneven.

Each of the electrode devices 25 and 26 comprises at least one horizontal electrode substantially insoluble in the electrolytic treating liquid to be applied to the metal strip. In the apparatus indicated in FIG. 2, each electrode device comprises a single electrode.

The electrode devices 25 and 26 are provided with a pair of upper and lower slits 30 and 31 for feeding the electrolytic treating liquid into the horizontal gaps 28 and 29, respectively. Each of the upper and lower slits 30 and 31 is formed in the middle portion of the corresponding electrode device 25 or 26 in such a manner that the slit 30 or 31 horizontally extends across the electrode device 25 or 26 at substantially right angles to the direction of movement of the metal strip 24 and is vertically directed to the corresponding gap 28 or 29 at substantially right angles to the horizontal path of the movement 23 of the metal strip 24.

That is, the feeding end of each slit 30 or 31 opens to the horizontal gap 28 or 29. The other end of each slit is connected to a supply source tank 32 of the electrolytic treating liquid through a valve 33, a pump 34, and a header 35 or 36 which is located just upstream of the slit 30 or 31.

The length of the slits is variable depending on the width of the metal strip to be treated. Also, the width of the slits is variable depending on the type of the electrolytic treatment and the flow rate of the electrolytic treating liquid to be supplied into each slit. Usually, it is preferable that the width of the slit corresponds to 1/50 to 1/200, more preferable, 1/100 to 1/150 of the length of the slit. Furthermore, the height of the slits is variable on the thickness of the corresponding electrode and shell. Usually, in order to make the streams of the electrolytic treating liquid in the slits uniform, it is preferable that the height of the slits be in the range of from ½ to 1/40, more preferably 1/5 to 1/10, of the length of the slit.

The sidth of the feeding end portion of each slit may be expanded outwardly facing the corresponding gap, as indicated in FIG. 2. This type of feeding end portion of the slit will be explained in detail hereinafter.

The upper and lower electrodes 25 and 26 are connected to a power source 37. Also, the metal strip 24 can be connected to the power source 37 through the feeding rolls 21. Accordingly, when voltage is applied between each of the electrode devices 25 and 26 and the metal strip 24, an electric current flows between each of the electrode device 25 and 26 and the metal strip 24 through the electrolytic treating liquid filled in the corresponding gap.

The upstream end and the downstream end of the upper gap 28 are defined by the upstream sealing plate 40 and a downstream sealing plate 41, respectively. The upstream end and the downstream end of the lower gap 29 are defined by an upstream sealing plate 42 and a downstream sealing plate 43. Each sealing plate 40, 41, 42, or 43 is movably connected to the corresponding upstream or downstream end of the electrode device 25 or 26, extends toward the corresponding surface of the metal strip 24, and is terminated at a location spaced from the surface so as to form an opening between the end of the sealing plate and the surface of the metal strip. A portion of the electrolytic treating liquid can flow out from the gap through the opening. The width of the opening can be controlled by moving the sealing plate up or down.

A funnel-shaped collecter 44 is arranged below the electrode devices 25 and 26. The portion of the electrolytic treating liquid discharged from the treating space 27 is collected by the collecter 44. The bottom of the collecter 44 is connected to the pump 34 through a tank 45 and a valve 46. A portion of the collected electrolytic treating liquid can be recycled into the headers 35 and 36 by means of the pump 34 or can be discharged to the outside of the apparatus through the valve 47.

When the method of the present invention is carried out by using the apparatus indicated in FIGS. 2 and 3, the steel strip 24 is fed into the apparatus by means of the feeding rolls 21, horizontally moves through the narrow treating space 27 at a predetermined speed, for example, from 150 to 300 m/min, and finally, is delivered from the apparatus by means of the delivering rolls 22.

The electrolytic treating liquid is fed from the supply source tank 32 into the upper and lower headers 35 and 36 through the valve 33 by means of the pump 34 under pressure. The electrolytic treating liquid is uniformly fed under pressure from the upper and lower heads 35 and 36, respectively, into the upper and lower gaps 28 and 29 through the upper and lower vertical slits 30 and 31.

That is, each stream of the electrolytic treating liquid is spouted vertically into the corresponding gap, and, then, is divided into two opposite flows. One flow is concurrent with movement of the metal strip. The other flow is countercurrent with movement of the metal strip. Each flow should have a uniform flow rate over the surface of the metal strip so that the surface of the metal strip can be uniformly treated.

Also, each flow should have a speed which is sufficient to remove gas bubbles from the surface of the electrode device.

The thickness of each gap is adjusted to a desired value, preferably, 30 or less.

The feeding rate of the electrolytic treating liquid into each slit is varible depending on the width of the metal strip to be treated, the type of the electrolytic treatment, the size of the slit, and the thickness of the horizontal gaps. Usually, the feeding rate is preferably in the range of from 0.005 to 0.4 $m^3$/min per cm of the length of the slit. In the case where the metal strip to be treated has a width of from 30 cm to 200 cm, and the thickness of the gaps is adjusted to 30 mm or less, the feeding rate of the electrolytic treating liquid to each slit may be in the range of 1.0 to 10 $m^3$/min.

The electrolytic treatment on the metal strip is effected by applying a predetermined intensity of electric current between the electrodes and the metal strip. The current density to be applied is variable depending on the type and speed of the metal strip and the type and concentration of the electrolytic treating liquid. Usually, it is preferable that the current density is in the range of from 10 to 200 A per $dm^2$ of each surface of the metal strip. When the metal strip moves at a speed of 150 m/min or more, for example, 150 to 300 m/min, it is preferable that the current density is in the range of 80 to 200 A/$dm^2$.

Figure 4:
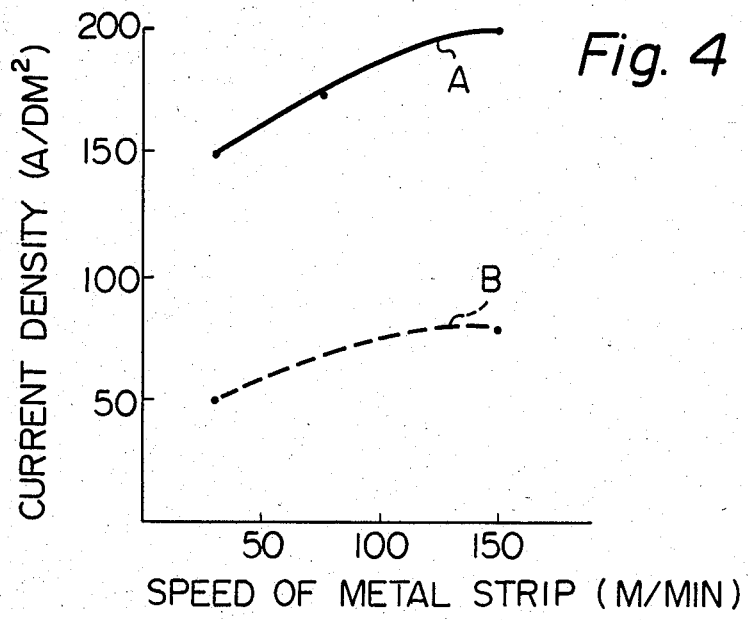
FIG. 4 is a graph showing relationships, in a prior art in the present invention, between the speed of a metal strip and the current density applied in a zinc-electroplating procedure of a steep strip.

FIG. 4 shows relationships between the speed of the metal strip and the current density applied to a zinc-plating procedure on a steel strip in a prior art method and the method of the present invention. In FIG. 4, Curve A shows the relationship in the method of the present invention. That is, when the steel strip moves at a speed of from 50 to 150 m/min, it is possible to increase the current density to a value on or below Curve A, that is, from about 150 to about 200 A/$dm^2$. That is, on Curve A or in the region below Curve A, the zinc-electroplating procedure can be carried out without producing undesirable burnt deposits on the plated steel strip even if a current density of 150 to 200 A/$dm^2$ is applied In FIG. 4, Curve B indicates the relationship between the speed of the steel strip and the current density in a zinc-electroplating method in a prior art. That is, when the steel strip moves at a speed of from 50 to 150 m/min, the current density should be adjusted to a value on or below Curve B. If the current density is a value above Curve B, the surface of the zinc-plated steel strip is exhibits undesirable burnt deposits.

Figure 5:
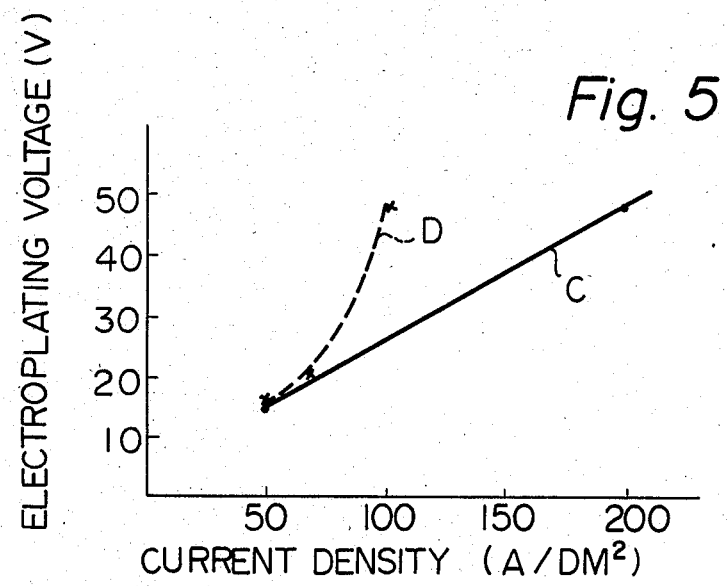
FIG. 5 is a graph showing relationships, in a prior art and in the present invention, between the current density and the voltage applied in a zinc-electroplating procedure on a steel strip.

In FIG. 5, Curve C indicates the relationship between the current density applied to the zinc-electroplating system and the voltage generated in the system in the method of the present invention. That is, in the zinc-electroplating procedure in accordance with the method of the present invention, the voltage gradually increases up to about 50 V with increases in the current density from 50 to 200 A/$dm^2$. Even when the zinc-electroplating procedure is carried out at a high current density of 200 A/$dm^2$, the voltage can be controlled to a level of 50 V or less. This advantage of the present invention is due to the fact that the gas bubbles, that is, oxygen gas bubbles, are satisfactorily removed from the surfaces of the electrode devices.

Curve D indicates the relationship between the current density and the voltage in the zinc-electroplating procedure in accordance with a prior art. Curve D clearly indicates that in order to carry out the zinc-electroplating procedure under a voltage of 50 V or less, it is necessary to limit the current density to a level of about 100 A/$dm^2$ or less.

In view of FIGS. 4 and 5, it is obvious that the method of the present invention can be carried out at a high speed of the metal strip and at a high current density without producing defects on the treated metal strip. This specific advantage of the present invention is derived from the fact that the high current density significantly promotes the electrolytic treatment on the metal strip. Also, the high speed of the metal strip and the specific mode of flowing of the electrolytic treating liquid through the horizontal gaps remarkably accelerate the removal of gas bubbles, for example, oxygen gas bubbles, generated during the electrolytic treating procedure from the surfaces of the electrodes to the outside of the treating space.

Figure 6:
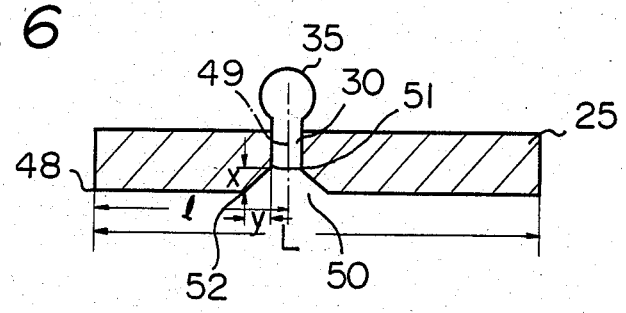
FIG. 6 is an explanatory cross-sectional view of an embodiment of the electrode device having a slit, usable for the present invention.
Figure 7:
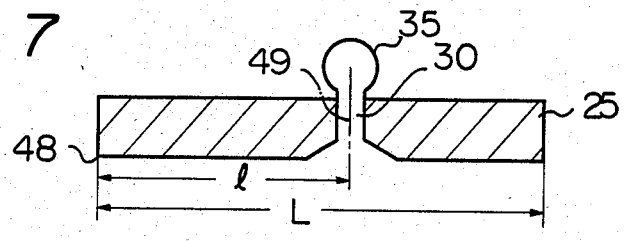
FIG. 7 is an explantory cross-sectional view of another embodiment of the electrode device having a slit, usable for the present invention.

In the apparatus of the present invention, the slit may be located at exactly the middle of the electrode device as indicated in FIGS. 2 and 3. The location of the slit may also be variable as long as the slit is located near the middle portion of the electrode device, as indicated in FIGS. 6 and 7. That is, Referring to FIGS. 6 and 7, when the entire length of the electrode device 25 is represented by L and the distance from the outermost end 48 to the center plane 49 of the slit 30 is represented by l, it is preferable that the following relationship is satisfied.

$$\frac{1}{3}L \leqq l \leqq \frac{2}{3}L$$

In the apparatus of the present invention, it is preferable that the width of the feeding end portion of the slit be expanded outwardly facing the corresponding gap between the electrode device and the metal strip, as shown in FIGS. 2, 6, and 7.

Referring to FIG. 6, the feeding end portion 50 of the slit 30 is expanded outwardly in width. This expanded feeding end portion 50 is effective for smoothly dividing the stream of the electrolytic treating liquid passed through the slit 30 into two opposite flows in the horizontal gap.

Also, the expanded feeding end portion 50 is effective for preventing undesirable formation of turbulence in the flows of the electrolytic treating liquid in the gaps. In the expanded feeding end portion 50, it is preferable that the height X which is the vertical distance between the inside end 51 and the outside end 52 of the expanded feeding end portion, is in the range of from 30 to 100 mm and that the horizontal distance Y, between the center plane 49 to the outside end 52 of the expanded feeding end portion, is in the range of from 30 to 500 mm.

The slit is directed vertically toward the surface of the metal strip at substantially right angles to the surface of the metal strip which is horizontal. The angle between the central plane of the slit and the horizontal surface of the metal strip may be in the range of from 80 to 100 degrees.

Figure 8:
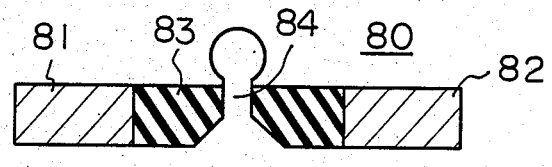
FIG. 8 is an explantory cross-sectional view of still another embodiment of the electrode device having a slit, usable for the present invention.

In the apparatus of the present invention, the electrode device may comprise a single horizontal electrode and the slit may be located in the middle portion of the electrode, as indicated in FIGS. 2, 3, 6, and 7. Otherwise, the electrode device may comprise at least two horizontal electrodes separated from each other, and at least one horizontal intermediate piece interposed between the electrodes, as indicated in FIG. 8. The intermediate piece is made from an electric insulating material.

Referring to FIG. 8, an electrode device 80 comprises two separate electrodes 81 and 82 and one intermediate 83 interposed between the electrodes 81 and 82. That is, the middle portion of the electrode device 81 is formed by the intermediate piece 83, and a slit 84 is formed in the middle portion of the intermediate piece 83. Usually, it is preferable that the entire length of at least one intermediate piece is ⅓ or less the entire length of the electrode device.

The electrode is made of an electroconductive material substantially insoluble in the electrolytic treating liquid to be applied to the metal strip. For example, the electrode may be made from a Pb-Sn alloy or may be a Pt-plated titanium electrode. The intermediate piece is made of an electric insulating material, for example, polyvinyl chloride resin, polypropylene resin, or fluoropolycarbonate.

In the apparatus of the present invention, the slit may be provided with one or more flow-uniforming plates placed therein.

Figure 9:
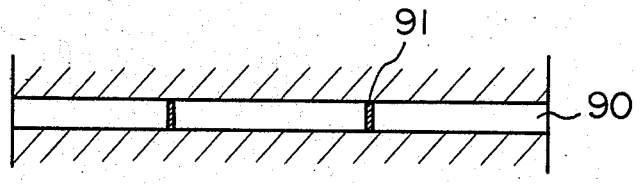
FIG. 9 is an explanatory plane view of an embodiment of the slit having flow-uniforming plates, usable for the present invention.

Referring to FIG. 9, the slit 90 has two flow-uniforming plates 91 which are effective for preventing the change in the width of the slot 90. Also, the plates 90 are effective for uniforming the stream of the electrolytic treating liquid over the slit 90.

The flow-uniforming plates may be in the form of a flat plate as indicated in FIG. 9. The flow-uniforming plates may also be in other forms as long as the plates are effective for attaining the above-mentioned advantages.

Figure 10:
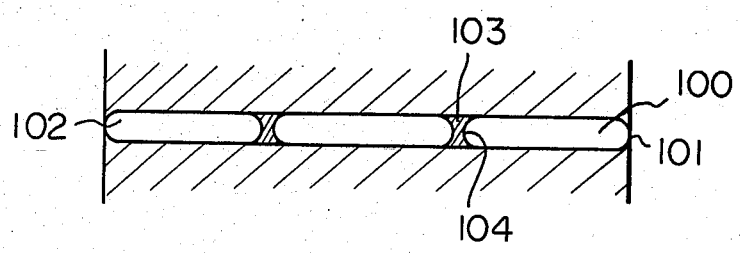
FIG. 10 is an explanatory plane view of another embodiment of the slit having another type of flow-uniforming plates, usable for the present invention.

For example, in the case as indicated in FIG. 10, where the slit 100 has both side ends 101 and 102 rounded outwardly, the flow-uniforming plates 103 may each have both side surfaces 104 concaved inwardly.

In the apparatus of the present invention, both the side ends of the treating space can be defined by a pair of side-masking devices which are movable horizontally in the direction at right angles to the direction of movement of the metal strip.

Figure 11:
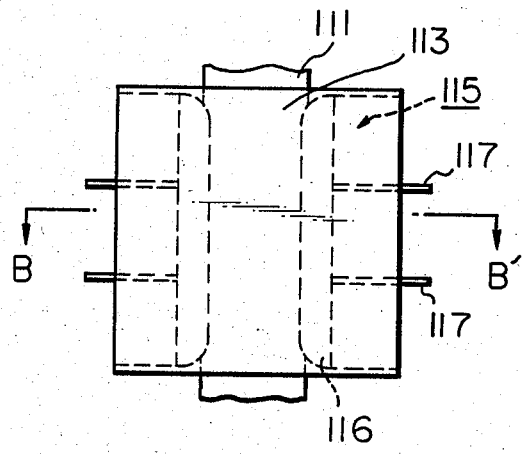
FIG. 11 is an explanatory plane view of an embodiment of the apparatus of the present invention equipped with a pair of side-masking devices.
Figure 12:
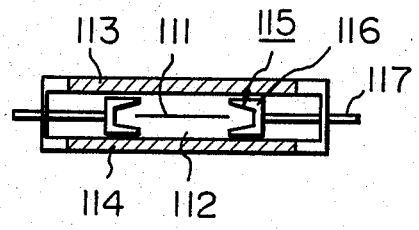
FIG. 12 is an explanatory cross-sectional view of the apparatus indicated in FIG. 11 along the line B—B'

Referring to FIGS. 11 and 12, a metal strip 111 passes through a treating space 112 formed between an upper electrode device 113 and a lower electrode device 114. Both side ends of the treating space 112 are defined by a pair of side-masking devices 115, each comprising a side mask member 116 having a C-shaped cross-sectional profile and at least one arm member 117, as indicated in FIG. 11 and 12. The location of the side-mask member 116 can be adjusted by moving it horizontally by using the arm member 117. When the side mask member 116 is located in an adequate position, the edge portion of the metal strip fed into the treating space can be protected from overtreatment thereof.

The method and apparatus of the present invention can be utilized for the continuous electrolytic treatment of a metal strip, for example, for the continuous electroplating or electrolytic pickling of a steel strip.

In the method of the present invention, the electrolytic treating liquid may be a sulfuric acid-containing electroplating liquid. For example, the electroplating liquid may have temperature of from 40° C. to 80° C. and a pH of from 0.8 l to 2.0. Also, the electroplating liquid may contain zinc or a zinc-based alloy, or other metals.

When the method and apparatus are used for the electroplating process of the steel strip with zinc or zinc alloy, the resultant plated steel strip has no burnt deposits of amorphous zinc or zinc alloy and exhibits a dark gray or black color, even in the case where a large current density of 200 A/dm$^2$ is applied.

The following specific examples are presented for the purpose of clarifying the present invention. However, it should be understood that these are intended only to be examples of the present invention and are not intended to limit the scope of the present invention in any way.

EXAMPLE 1

A cold rolled steel strip having a thickness of 0.7 mm and a width of 550 mm was subjected to the continuous electroplating procedure with zinc by using the apparatus indicated in FIGS. 2 and 3.

In this apparatus, the electrode devices had a length of 1900 mm and the slits had a length of 20 mm, a width of 1300 mm and a height of 90 mm. The expanded feeding end portions of the slits had a height x of 200 mm and a distance y of 300 mm. The thickness of the horizontal gaps between the electrode devies and the steel strip was 15 mm.

The electroplating liquid used contained 300 g/l of $ZnSO_4.7H_2O$, 100 g/l of $Na_2SO_4$, 23 g/l of $H_2SO_4$, and had a pH of 1.3 and a temperature of 50° C.

The steel strip was fed into the apparatus at a speed of 30 m/min and moved through the treating space. Then, the plated steel strip was delivered from the apparatus.

The electroplating liquid was fed into each slit at a feeding rate of 5 m$^3$/min, and an electric current was applied between each electrode and the steel strip at a current density of 150 A/dm$^2$ of the surface of the steel strip.

It was found that the voltage generated between the electrode and the steel trip was 10 V.

Both surfaces of the steel strip were plated with uniform, smooth zinc layers having a weight of 6.0 g/m$^2$ and containing no burnt deposits.

EXAMPLE 2

A cold rolled steel strip having a thickness of 1.0 mm and a width of 300 mm was continuously electroplated with zinc by using the same apparatus as that described in Example 1 in the same manner as that indicated in Example 1, except that the feeding rate of the electroplating liquid to each slit was 7 m$^3$/min and the current density was 200 A/dm$^2$.

It was found that the voltage generated between the electrode and the steel strip was 31 V.

The resultant steel strip had both surfaces plated with uniform, smooth zinc layers having a weight of 19.0 g/m$^2$ and containing no burnt deposits.

We claim:

1. A method for the continuous electrolytic treatment of a metal strip with an electrolytic treating liquid using horizontal electrodes substantially insoluble in said electrolytic treating liquid, comprising the steps of:

moving a metal strip horizontally through a narrow treating space formed between a pair of feeding rolls and a pair of delivering rolls and between horizontal upper and lower electrode devices facing each other, each device comprising at least one electrode substantially insoluble in an electrolytic treating liquid to be applied, whereby said treating space is divided into upper and lower horizontal gaps by said metal strip;

feeding upper and lower streams of said electrolytic treating liquid into said upper and lower gaps, respectively, through upper and lower slits, each formed in the middle portions of the corresponding electrode device, each extending horizontally across the corresponding electrode device at substantially right angles to the direction of movement of said metal strip, and each directed vertically to the corresponding surface of the metal strip at substantially right angles to the surface of the metal strip, wherein each slit is unobstructed across its length except for at least one vertically disposed flow-uniforming plate placed in each slit with an orientation parallel to the direction of movement of said mmetal strip and the width of the feeding end portion of each slit is expanded outwardly facing the corresponding gap whereby uniform streams of electrolytic treating liquid are fed through each slit, and whereby each stream of said electrolytic treating liquid passed into the corresponding gap is divided into a pair of flows concurrent and counercurrent with the movement of said metal strip, each flow having a uniform flow rate over the corresponding surface of said metal strip; and applying an electric current between each electrode and said metal strip through said feeding rolls, whereby said metal strip is electrolytically treated with said electrolytic treating liquid.

2. A method as claimed in claim 1, wherein said metal strip is moved at a speed of from 150 to 300 m/min.

3. A method as claimed in claim 1, wherein said electrolytic treating liquid is fed into each gap at a feeding rate of 0.005 to 0.4 $m^3$/min per cm of the length of said slit.

4. A method as claimed in claim 1, wherein the current density of said electric current is in the range of from 10 to 200 A per $dm^2$ of each surface of said metal strip.

5. A method as claimed in claim 4, wherein the current density is in the range of from 80 to 200 A/$dm^2$.

6. A method as claimed in claim 1, wherein a portion of said electrolytic treating liquid is discharged from said treating space, the discharged portion of said electrolytic treating liquid being collected and then recycled into said slits.

7. A method as claimed in claim 1, wherein said electrolytic treating liquid is a sulfuric acid-containing electroplating acid liquid.

8. A method as claimed in claim 7, wherein said electroplating liquid has a temperature of from 40° C. to 80° C. and a pH of from 0.8 to 2.0.

9. A method as claimed in claim 7, wherein said electroplating liquid contains zinc or a zinc-based alloy.

10. A method as claimed in claim 1, wherein the thickness of the gaps is adjustable to 30 mm or less.

11. An apparatus for the continuous electrolytic treatment of a metal strip with an electrolytic treating liquid using horizontal electrodes substantially insoluble in said electrolytical treating liquid, comprising:

means for feeding a metal strip;

means for delivering said metal strip, which means is located downstream said feeding means in such a manner that a horizontal path of movement of said steel strip is provided between said feeding means and said delivering means;

upper and lower horizontal electrode devices which are arranged, respectively, above and below said horizontal path of movement of said metal strip between said feeding means and said delivering means in such a manner as to form a treating space between the upper and lower electrode devices, said treating space being divided into upper and lower horizontal gaps by the horizontal path of movement of said metal strip, and each electrode device comprising at least one horizontal electrode substantially insoluble in the electrolytic treating liquid to be applied to said metal strip and being provided with a slit for feeding said electrolytic treating liquid into the corresponding gap, which slit is formed in the middle portion of said electrode device, which slit extends horizontally across said electrode device at substantially right angles to the direction of movement of said metal strip, which slit is directed vertically to the corresponding gap at substantially right angles to the horizontal path of movement of said metal strip, and which slit is connected to a source of supply of said electrolytic treating liquid and wherein each slit is unobstructed across its length except for at least one vertically disposed flow-uniforming plate placed in each slit with an orientation parallel to the direction of movement of said metal strip and the width of the feeding end portion of each slit is expanded outwardly facing the corresponding gap, whereby uniform streams of electrolytic treating liquid are fed through each slit; and means for applying an electric current between each electrode and said metal strip through said feeding means.

12. An apparatus as claimed in claim 11, wherein each electrode device comprises a single horizontal electrode and said slit is formed in the middle portion of said electrode.

13. An apparatus as claimed in claim 11, wherein each electrode device comprises at least two horizontal electrodes separated from each other and at least one horizontal intermediate piece arranged between the electrodes and made from an electric insulating material.

14. An apparatus as claimed in claim 13, wherein the middle portion of said electrode device is formed by said intermediate piece and said slit is located in said intermediate piece.

15. An apparaus as claimed in claim 13, wherein the entire length of said at least one intermediate piece is ⅓ or less the entire length of said electrode device.

16. An apparatus as claimed in claim 11, wherein said outwardly expanded feeding end portion of each slit has a height of from 30 to 100 mm and a distance of 30 to 500 mm from a center plane of the slit to the outermost end of the expanded portion of the slit.

17. An apparatus as claimed in claim 11, wherein said supply source of said electrolytic treating liquid is provided with upper and lower headers located just upstream said upper and lower slit, respectively.

18. An apparatus as claimed in claim 11, wherein the upstream end and the downstream end of each of said upper and lower gaps with respect to the direction of movement of said metal strip are defined by an upstream sealing plate and a downstream sealing plate, respectively, each plate being movably connected to the corresponding end of said electrode device, extending toward the corresponding surface of the said metal strip and being terminated at a location spaced from the corresponding surface of said metal strip.

19. An apparatus as claimed in claim 11, wherein both side ends of the treating space are defined by a pair of side-masking devices which are movable horizontally in the direction at right angles to the direction of movement of said metal strip.

20. An apparatus for the continuous electrolytic treatment of a metal strip with an electrolytic treating liquid using horizontal electrodes substantially insoluble in said electrolytical treating liquid, comprising:

means for feeding a metal strip;

means for delivering said metal strip, which means is located downstream said feeding means in such a manner that a horizontal path of movement of said metal strip is provided between said feeding means and said delivering means;

upper and lower horizontal electrode devices which are arranged, respectively, above and below said horizontal path of movement of said metal strip between said feeding means and said delivering means in such a manner as to form a treating space between the upper and lower electrode devices, said treating space being divided into upper and lower horizontal gaps by the horizontal path of movement of said metal strip, and each electrode device comprising at least one horizontal electrode substantially insoluble in the electrolytic treating liquid to be applied to said metal strip and being provided with a slit for feeding said electrolytic treating liquid into the corresponding gap, which slit is formed in the middle portion of said electrode device, which slit extends horizontally across said electrode device at substantially right angles to the direction of movement of said metal strip, which slit is directed vertically to the corresponding gap at substantially right angles to the horizontal path of movement of said metal strip, and which slit is connected to a source of supply of said electrolytic treating liquid and wherein said slit is unobstructed across its length except for at least one vertically disposed flow-uniforming plate placed in each slit with an orientation parallel to the direction of movement of said metal strip and the width of the feeding end portion of each slit is expanded outwardly facing the corresponding gap, whereby uniform streams of electrolytic treating liquid are fed through each slit;

means for applying an electric current between each electrode and said metal strip through said feeding means; and wherein the upstream end and the downstream end of each of said upper and lower gaps with respect to the direction of movement of said metal strip are defined by an upstream sealing plate and a downstream sealing plate, respectively, each plate being movably connected to the corresponding end of the electrode device, extending toward the corresponding surface of the metal strip and being selectively terminated at a location spaced from the corresponding surface of said metal strip.

* * * * *

UNITED STATES PATENT AND TRADEMARK OFFICE

CERTIFICATE OF CORRECTION

PATENT NO. : 4,584,066

DATED : April 22, 1986

INVENTOR(S) : Ando Narumi, et al.

It is certified that error appears in the above-identified patent and that said Letters Patent is hereby corrected as shown below:

Column 2, line 8, change "deposites" to --deposits--.

Column 2, line 37, change "another" to --other--.

Column 3, line 14, omit the word "for".

Column 3, line 43, change "steep" to --steel--.

Column 3, line 51, change "explantory" to --explanatory--.

Column 3, line 54, change "explantory" to --explanatory--.

Column 5, line 38, change "is 30mm"to --be 30 mm-- and insert a comma after the word "less".

Column 5, line 39, after the word "preferable" insert a comma.

Column 5, line 40, change "sometimes, it" to --it sometimes--.

Column 6, line 13, after "1/10" insert a comma.

UNITED STATES PATENT AND TRADEMARK OFFICE

CERTIFICATE OF CORRECTION

PATENT NO. : 4,584,066

DATED : April 22, 1986

INVENTOR(S) : Ando Narumi, et al.

It is certified that error appears in the above-identified patent and that said Letters Patent is hereby corrected as shown below:

Column 6, line 15, change "sidth" to --width--.

Column 6, line 65, change "heads" to --headers--.

Column 7, line 15, change "varible" to --variable--.

Column 7, line 57, omit the word "is" at the end of the line.

Column 8, line 31, change "Referring" to --referring--.

Column 8, line 35, change "relationship is" to --relationship be--.

Column 8, line 58, change "is" to --be--.

Column 8, line 60, change "center plane 49 to the outside end 52" to --inside end 51 and outside end 52--.

Column 9, line 12, after "intermediate" insert the word --piece--.

Column 9, line 59, change "FIG. 11 and 12" to --FIGS. 11 and 12--.

UNITED STATES PATENT AND TRADEMARK OFFICE

CERTIFICATE OF CORRECTION

PATENT NO. : 4,584,066

DATED : April 22, 1986

INVENTOR(S) : Ando Narumi, et al.

It is certified that error appears in the above-identified patent and that said Letters Patent is hereby corrected as shown below:

Column 10, line 5, change "0.8 l to 2.0" to --0.8 to 2.0--.

Column 10, line 30, change "devies" to --devices--.

Column 10, line 33, change "$ZnSO_4.7H_2O$" to --$ZnSO_4 \cdot 7H_2O$--.

Column 11, line 22, change "mmetal" to --metal--.

Column 11, line 28, change "couner-" to --counter---.

Column 13, line 15, change "electrolytical" to --electrolytic--.

Signed and Sealed this

*Thirtieth* Day of *September 1986*

[SEAL]

*Attest:*

DONALD J. QUIGG

*Attesting Officer* *Commissioner of Patents and Trademarks*